United States Patent [19]

Steiner

[11] Patent Number: 4,586,541

[45] Date of Patent: May 6, 1986

[54] WEAVING ROTOR

[75] Inventor: Alois Steiner, Rieden, Switzerland

[73] Assignee: Sulzer-Ruti Machinery Work Ltd., Ruti, Switzerland

[21] Appl. No.: 675,234

[22] Filed: Nov. 27, 1984

[30] Foreign Application Priority Data

Dec. 1, 1983 [EP] European Pat. Off. ..... 83112064.7

[51] Int. Cl.[4] ..... D03D 47/30

[52] U.S. Cl. ..... 139/435; 139/28

[58] Field of Search ..... 139/11 R, 435, 28; 137/624.18, 624.2

[56] References Cited

U.S. PATENT DOCUMENTS 4,262,707 4/1981 Suzuki ..... 139/435

4,505,306 3/1985 Lincke et al. ..... 139/435

FOREIGN PATENT DOCUMENTS 2344717 5/1975 Fed. Rep. of Germany ..... 139/435

*Primary Examiner*—Henry S. Jaudon

*Attorney, Agent, or Firm*—Kenyon & Kenyon

[57] ABSTRACT

The weaving rotor has a row of radial bores disposed on a generatrix coincident with the relay nozzles of a picking comb. A stationary control tube which is supplied with compressed air is disposed within the rotor and has a row of slots which register with the rotor bores and which are disposed on a helix offset from the generatrix of the rotor bores in the direction of rotation. During rotation of the rotor, air is sequentially directed to the relay nozzles.

The control tube also has a second row of bores to permit the blowing of air through all of the relay nozzles simultaneously.

9 Claims, 3 Drawing Figures

30
31
5
4
9
12
11
1
15
7
6
10
25
21
18
17
16
15
11
8
2
3

1
6
7
18
12
9
21
17
16
23
19
25
120°

18''
21''
27
20
22
y
1
21
18
26
18'
21'
25
0°
120°

WEAVING ROTOR

This invention relates to a weaving rotor. More particularly, this invention relates to a weaving rotor for a pneumatic superposed shed type weaving machine.

Heretofore, it has been known to construct a superposed shed type weaving machine with a rotor which has one or more combs for the picking of weft threads into a shed of warp threads. In some cases, the picking comb has been constructed of a plurality of slats or teeth which are shaped to define a picking tunnel through which a weft thread can be picked. However, several problems arise with respect to the picking of a weft thread through such combs. In order to solve one such problem, it has been proposed to incorporate relay nozzles at intervals across the picking comb in order to inject compressed air to assist in the transport of the weft thread. However, since the rotor rotates in operation, control of the compressed air for a particular relay nozzle that is to be activated must be accommodated in the rotor itself.

Accordingly, it is an object of the invention to provide a rotor for a pneumatic weaving machine which has a self-contained control for the emission of air across the length of a picking comb.

It is another object of the invention to provide a relatively simple construction for controlling the emission of air from a weaving rotor of a pneumatic superposed shed type weaving machine.

It is another object of the invention to reduce the time required for maintenance of a pneumatic control system for a weaving rotor.

Briefly, the invention is directed to a rotor for a pneumatic weaving machine which has a row of radial bores for passing compressed air therethrough. In accordance with the invention, a stationary control tube is slidably mounted within the rotor for receiving a flow of compressed air. In addition, the control tube has a first row of radial bores disposed along a helix offset from and circumferentially aligned with the bores in the rotor in order to sequentially deliver compressed air to the bores in the rotor as the rotor rotates relative to the control tube.

During rotation of the rotor relative to the control tube, blasts of compressed air can be ejected in a sequential manner through a series of relay nozzles, for example disposed within a picking comb mounted on the rotor and aligned with the bores in the rotor. In this respect, the bores in a control tube may be elongated so as to provide for an extended period of blow. Further, the bores in the control tube can be staggered in a manner so that a multiplicity of relay nozzles can have air blown therethrough simultaneously.

The control tube may also be provided with a second row of radial bores which are disposed to periodically coincide radially with the bores in the rotor in order to simultaneously deliver compressed air to the bores in the rotor. In this way, after a picking operation has been completed, air can be blown through all of the relay nozzles in the picking comb Further, the last bore of the second row of bores can be made to coincide with the last bore of the first row of bores in the control tube.

These and other objects and advantages of the invention will become more apparent from the following detailed description taken in conjunction with the accompanying drawings wherein.

Figure 3:
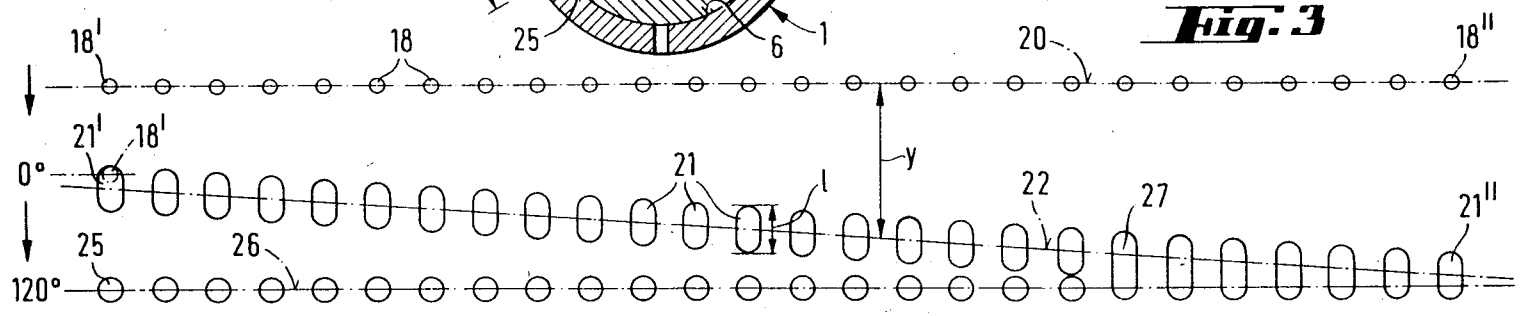

FIG. 3 diagramatically illustrates a developed view of the bores in a rotor and control tube in accordance with the invention.

Figure 1:
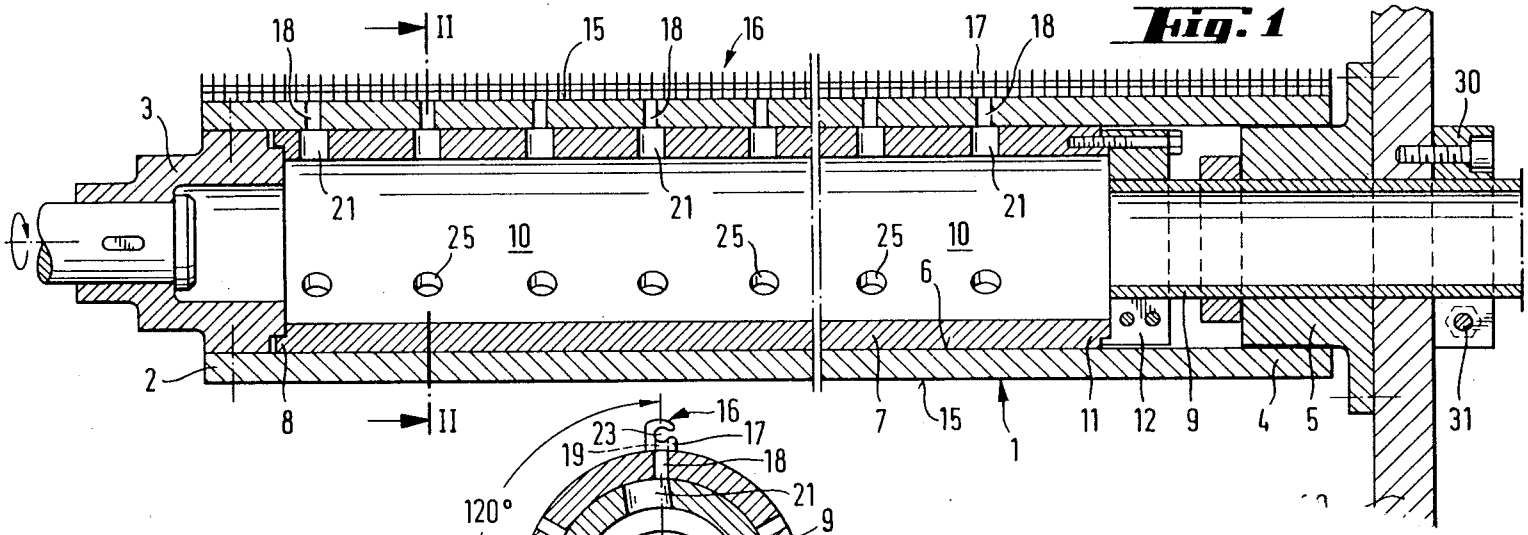
FIG. 1 illustrates a longitudinal cross-sectional view of a rotor constructed in accordance with the invention.

Referring to FIG. 1, the weaving rotor 1 which is incorporated in a pneumatic weaving machine has one end 2 which is rigidly connected to a shaft journal 3 while the opposite end 4 is mounted on a shaft journal 5 so as to be freely rotatable. The shaft journal 3 is driven by a main shaft of the weaving machine while the journal 5 is stationary.

A stationary control tube 7 is disposed in the rotor 1 so as to have a reduced clearance from an inner wall 6 of the rotor 1. One end 8 of the tube 7 is rotatably mounted on the journal 3 while the other end 11 is clamped in a fixed manner to a tube 9 by means of a clamping ring 12. This tube 9 extends through the stationary journal 5 to communicate with a supply of compressed air. As indicated, the tube 9 extends to the interior 10 of the control tube 7.

The tube 9 is secured to a frame 29 of the weaving machine by means of a clamping ring 30. Thus, the tube 9 and the control tube 7 cannot rotate.

Figure 2:
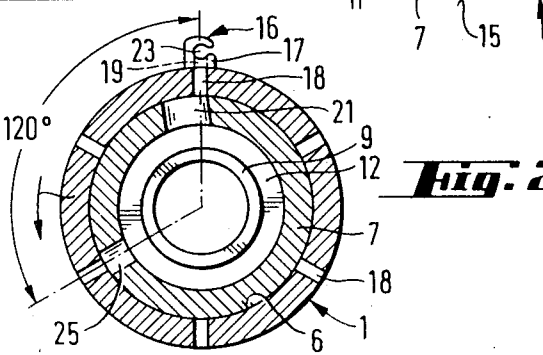
FIG. 2 illustrates a view taken on line II—II of FIG. 1.

Referring to FIGS. 1 and 2, a series of picking combs 16 (only one of which is shown) are mounted on the periphery 15 of the rotor 1 to alternate in the circumferential direction with a similar number of beating-up combs. In each case, the picking combs 16 and beating-up combs are of slat type. In addition, each picking comb 16 is provided with a plurality of relay nozzles 17 which are distributed over the weaving width of the rotor 1. In addition, the rotor 1 is provided with a plurality of radial bores 18 which are aligned in a single row along a first generatrix 20 and which are circumferentially aligned with the relay nozzles 17 of the picking comb 16 in order to deliver compressed air to the nozzles 17. As indicated in FIG. 2, an air supply duct 19 is provided in the comb at each relay nozzle 17.

Referrings to FIGS. 1 and 3, the control tube 7 is formed of a row of radial bores or slots 21 which are equal in number to the number of bores 18 in the rotor 1. These bores or slots 21 are disposed along an elongated helix 22 which extends on the periphery of the tube 7 and which is offset from the generatrix 20 in the direction of rotation. Each slot 21 is circumferentially aligned with a bore 18 in the rotor 1 with a slot length 1 which is determined by the picking operation of the weaving machine.

Referring to FIG. 2, if the warp extends around the rotor 1 through an angle of 120°, a weft thread must be completely picked in the period of time in which the rotor 1 has turned through 120°, i.e. the end of the weft thread must have moved over the complete weaving width. Consequently, during this 120° rotation of the rotor 1, the relay nozzles 17 of the particular picking comb concerned must be supplied with compressed air from the control tube 7 in accordance with the advance of the thread end in a picking channel or tunnel. The length 1 of the slots 21 in the control tube 7 is adapted to the required relay nozzle blowing time. The peripheral distance y between a rotor bore 18 and a control tube slot 21 is determined by the place which a weft thread end has reached at a given yarn speed and at the instaneous angle of rotation.

When the rotor is in operation, the interior of the control tube 7 is kept full of compressed air. As the rotor 1 turns through 120° in the direction indicated by an arrow, the rotor wall bores 18 move seriatim, starting with the wall bore 18' and ending with the wall bore 18'', from left to right over the stationary control tube slots 21' to 21'', so that a flow connection for the compressed air between the control tube 7 and the air supply duct 19 is produced in each relay nozzle 17. The relay nozzle 17 blows the weft further on its way through the picking channel of the picking comb. When a rotor wall bore 18 leaves a control tube slot 21, the flow connection ceases and the associated relay nozzle 17 ceases to blow. The slots 21 are so disposed in the peripheral direction of the rotor 1 that a number of consecutive relay nozzles 17 blow simultaneously for each weft thread in a picking channel. In this example, about eight nozzles blow simultaneously in this way.

The control tube 7 is also formed with a second row of radial bores 25, for example of circular shape. These bores 25 are disposed to periodically coincide radially with the bores 18 and the rotor 1 in order to simultaneously deliver compressed air to the bores 18 and the rotor 1. As indicated in FIG. 3, the bore 25 are disposed on a generatrix 26 at a place where picking has finished, i.e. after the rotor 1 has rotated through 120°. Since the bores 25 come closer and closer to the slots 21 in the picking direction, the slots 21 and the bores 25 combine into a longer slot 27 near the end of the rotor 1. Upon completion of the 120° rotation, the weaving machine must be stopped in the event of weaving errors, such as a mispick or weft break. Because of the presence of the row of bores 25, which are in radial alignment with the row of rotor bores 18 at the end-of-pick position, all the relay nozzles 17 are supplied with compressed air from the control tube 7 simultaneously. Thus, after clearing a picking error, a new weft thread can be inserted into the picking channel of the particular picking comb concerned, whereafter the new weft is beaten up. Depending upon the size of the bores 25 or of the pressure of the blowing air, the number of bores 25 can be less than the number shown; for instance, a single bore 25 can be associated merely with every other bore.

Referring to FIG. 1, the clamping ring 30 may be provided with a screw 31 to permit release of the tube 9 for rotation Thus, after the screw 31 has been slackened, the tube 9 can be rotated so that the control tube 7 can be rotated relative to the rotor 1 i.e. circumferentially adjusted in the frame 29. This permits the start and end of the relay nozzle blowing times to be adjusted.

The invention thus provides a relatively simple control by means of which a series of relay nozzles in a picking comb on a weaving rotor can be sequentially activated. The construction of the control tube and rotor is relatively simple and requires little attention during use.

What is claimed is:

1. In combination, a rotor for a pneumatic weaving machine having a plurality of radial bores disposed on a first generatrix;

at least one picking comb mounted on said rotor and including a plurality of relay nozzles aligned with said bores for receiving compressed air therefrom; and a stationary control tube mounted within said rotor, said control tube having a first row of radial bores disposed therein along a helix offset from and circumferentially aligned with said bores in said rotor, the first bore of said control tube being circumferentially spaced from the last bore of said control tube over an arc length equal to an angle of engagement of a warp around said rotor.

2. The combination as set forth in claim 1 wherein said radial bores in said control tube are circumferentially elongated.

3. The combination as set forth in claim 2 wherein the length of each elongated radial bore is adapted to the required blowing time of a respective relay nozzle.

4. The combination as set forth in claim 1 wherein said control tube includes a second row of bores disposed on a generatrix to periodically coincide radially with said bores in said rotor and wherein the last bore of said second row coincides with the last bore of said first row.

5. The combination as set forth in claim 1 which further comprises a frame with said control tube being mounted in said frame for circumferential adjustment therein.

6. In combination, a rotor for a pneumatic weaving machine having a row of radial bores for passing compressed air therethrough; and a stationary control tube slidably mounted within said rotor for receiving a flow of compressed air therein, said tube having a first row of radial bores disposed along a helix offset from and circumferentially aligned with said bores in said rotor to sequentially deliver compressed air to said bores in said rotor and a second row of radial bores disposed to periodically coincide radially with said bores in said rotor to simultaneously deliver compressed air to said bores in said rotor and wherein the last bore of said second row coincides with the last bore of said first row.

7. The combination as set forth in claim 6 wherein the first bore and the last bore of said first row of bores in said control tube are circumferentially spaced over an angle of 120°.

8. The combination as set forth in claim 7 which further comprises means for rotating said control tube relative to said rotor.

9. The combination as set forth in claim 7 which further comprises means for supplying compressed air to said control tube.

* * * * *